US009222405B2

(12) United States Patent
Winter

(10) Patent No.: US 9,222,405 B2
(45) Date of Patent: Dec. 29, 2015

(54) TURBOCHARGED SINGLE CYLINDER INTERNAL COMBUSTION ENGINE USING AN AIR CAPACITOR

(71) Applicant: Massachusetts Institute of Technology, Cambridge, MA (US)

(72) Inventor: Amos Greene Winter, Somerville, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 0 days.

(21) Appl. No.: 14/320,717

(22) Filed: Jul. 1, 2014

(65) Prior Publication Data

US 2015/0007560 A1 Jan. 8, 2015

Related U.S. Application Data

(60) Provisional application No. 61/843,501, filed on Jul. 8, 2013.

(51) Int. Cl.
*F02B 37/02* (2006.01)
*F02B 29/04* (2006.01)
(Continued)

(52) U.S. Cl.
CPC ..... *F02B 37/02* (2013.01); *F02B 21/00* (2013.01); *F02B 29/04* (2013.01); *F02B 75/16* (2013.01); *F02B 21/02* (2013.01); *F02B 29/0456* (2013.01); *F02B 29/0493* (2013.01)

(58) Field of Classification Search
CPC ..... F02B 29/04; F02B 37/02; F02B 75/16; F02B 21/00; F02B 21/02; F02B 29/0456; F02B 29/0493
USPC ..... 60/605.1, 626, 611; 123/564
See application file for complete search history.

(56) References Cited

U.S. PATENT DOCUMENTS 2,965,083 A * 12/1960 Percival ..... F02B 27/00 123/559.1
5,064,423 A * 11/1991 Lorenz ..... B60T 17/02 123/586

(Continued)

FOREIGN PATENT DOCUMENTS

DE 3832013 A1 3/1990
FR 2919349 A3 1/2009

(Continued)

OTHER PUBLICATIONS

Aoi et al., Auto bicycle (translation JP 58128925 A), Aug. 27, 2015, entire document.*

(Continued)

*Primary Examiner* — Jorge Pereiro
*Assistant Examiner* — Jason T Newton
(74) *Attorney, Agent, or Firm* — Sam Pasternack; MIT Technology Licensing Office

(57) ABSTRACT

Internal combustion engine system. The system includes a single cylinder engine having an engine volume, the single cylinder engine having an intake manifold for introducing air into the engine and an exhaust manifold for discharge of exhaust gases. A turbocharger communicates with the exhaust manifold to receive exhaust gases to power the turbocharger. The turbocharger includes a compressor section communicating with the intake manifold to pressurize ambient air. An air capacitor is arranged to receive the pressurized ambient air from the turbocharger and to deliver the pressurized air to the engine during an intake stroke.

6 Claims, 3 Drawing Sheets

(51) Int. Cl.

| | |
|---|---|
| ***F02B 75/16*** | (2006.01) |
| ***F02B 21/00*** | (2006.01) |
| *F02B 21/02* | (2006.01) |

(56) References Cited

U.S. PATENT DOCUMENTS

| | | | | |
|---|---|---|---|---|
| 6,241,498 | B1 * | 6/2001 | Hansen | F04C 18/126 123/559.1 |
| 8,584,783 | B2 * | 11/2013 | Saeki | B62K 19/30 180/219 |
| 8,628,452 | B2 * | 1/2014 | Nemeth | B60W 10/06 477/107 |
| 8,646,438 | B2 * | 2/2014 | Saeki | F02B 33/40 123/184.56 |
| 2003/0111035 | A1 * | 6/2003 | Linhart et al. | 123/184.53 |
| 2005/0120991 | A1 * | 6/2005 | Neuschwander | F02M 35/10052 123/184.47 |
| 2010/0095927 | A1 * | 4/2010 | Salminen | 123/254 |
| 2011/0023820 | A1 * | 2/2011 | Donitz et al. | 123/316 |
| 2011/0132335 | A1 * | 6/2011 | Pursifull et al. | 123/564 |
| 2014/0102427 | A1 * | 4/2014 | Korenaga et al. | 123/568.12 |
| 2014/0200791 | A1 * | 7/2014 | Saito et al. | 701/102 |
| 2015/0083513 | A1 * | 3/2015 | Ito | B60K 13/02 180/229 |
| 2015/0107563 | A1 * | 4/2015 | Naruoka | F02M 35/14 123/559.1 |

FOREIGN PATENT DOCUMENTS

| | | | | |
|---|---|---|---|---|
| GB | 2453593 | A | 4/2009 | |
| JP | S58128925 | A * | 8/1983 | F02B 61/02 |

OTHER PUBLICATIONS

International Search Report and Written Opinion of the International Searching Authority for PCT/US2014/045569 mailed on Oct. 30, 2014.

* cited by examiner

TURBOCHARGED SINGLE CYLINDER INTERNAL COMBUSTION ENGINE USING AN AIR CAPACITOR

This application claims priority to provisional application Ser. No. 61/843,501 filed on Jul. 8, 2013, the contents of which are incorporated herein by reference.

BACKGROUND OF THE INVENTION

This invention relates to a single cylinder four stroke engine and more particularly to such an engine incorporating a turbocharger whose output is buffered by an air capacitor.

Turbocharging increases the power density of internal combustion (IC) engines, compared to naturally aspirated engines, by forcing more fresh air into the combustion chamber to burn more fuel. Most modern diesel engines, with the exception of single-cylinder engines, use turbocharging to generate more power from a smaller capacity, lighter engine than could be achieved through natural aspiration. Turbocharged engines are also more efficient than naturally aspirated engines of equivalent power, as frictional losses within an engine scale with its size. Conventional single-cylinder, four stroke IC engines are difficult to turbocharge because the intake and exhaust strokes are out of phase; when the turbocharger is powered by exhaust gasses, fresh air cannot be pumped into the engine because the intake valve is closed.

In some applications, it is practical to add additional cylinders to an engine so it can be turbocharged. This is a cost-effective solution for vehicles such as three-cylinder economy cars, as the engine cost is a relatively small fraction of the overall vehicle cost. But in smaller applications such as motorcycles, tractors, generators, and water pumps, engine cost is a large fraction of the overall device cost and there is an economic advantage to having a single cylinder, which has fewer precision-machined parts. Adding a turbocharger to a single-cylinder engine costs as little as 20% as much as adding an additional cylinder.

SUMMARY OF THE INVENTION

The internal combustion engine system, according to the invention, includes a single cylinder engine having an engine volume, the single cylinder engine also having an intake manifold for introducing air into the engine and an exhaust manifold for discharge of exhaust gasses. A turbocharger communicates with the exhaust manifold to receive the exhaust gasses to power the turbocharger. The turbocharger includes a compressor section communicating with the intake manifold to pressurize ambient air. An air capacitor, having a capacitor volume, is arranged to receive the pressurized ambient air from the turbocharger, and to deliver the pressurized air to the engine. In a preferred embodiment, the capacitor volume is in the range of two to five times the engine volume. In a particularly preferred embodiment the capacitor volume is approximately four to five times the engine volume. In another preferred embodiment, the air capacitor includes structure to cool the air within the air capacitor. Such structure may include cooling fins disposed on a surface of the air capacitor.

In another preferred embodiment, the single cylinder engine powers a device that includes frame tubing in which at least a part of the frame tubing constitutes the air capacitor. It is preferred that the capacitor volume be selected so that at least about 80% of the turbocharger pressure is delivered to the cylinder throughout an intake stroke.

DESCRIPTION OF THE PREFERRED EMBODIMENT

Figure 1:
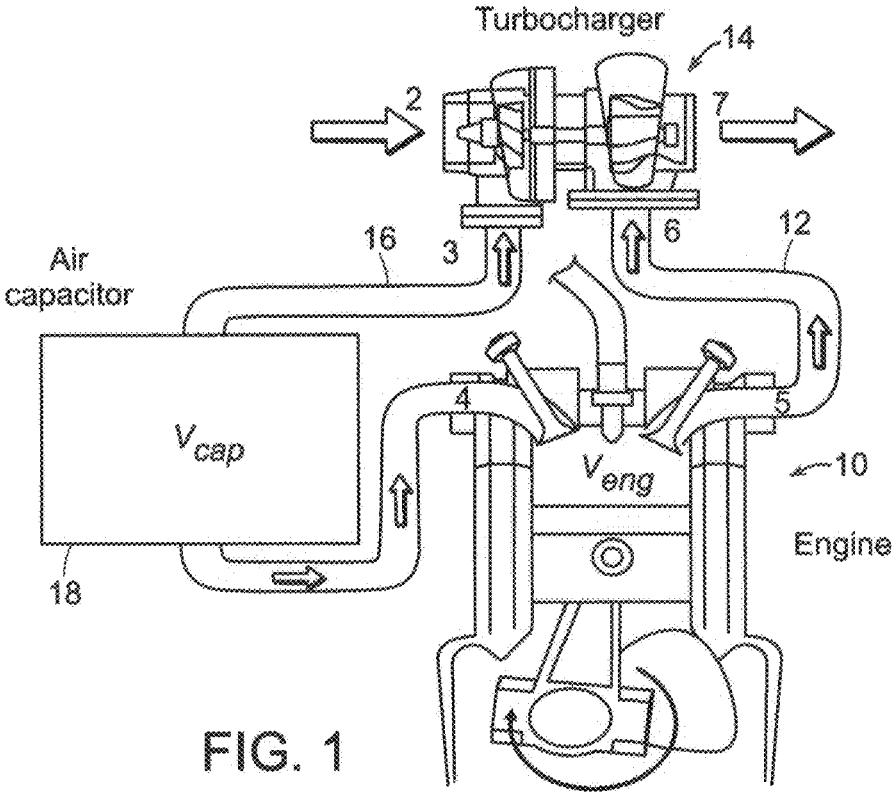
FIG. 1 is a schematic illustration of an embodiment of the turbocharged, single cylinder engine disclosed herein.

With reference first to FIG. 1, a four stroke, internal combustion engine 10 includes an exhaust manifold 12 for delivery of exhaust gases to a turbocharger 14. The turbocharger 14 provides pressurized air into intake manifold 16. An air capacitor 18 is disposed in the intake manifold and delivers pressurized air into the engine 10. By adding an air capacitor to the intake manifold 16, fresh air pressurized by the turbocharger 14 is stored during the exhaust stroke and delivered to the combustion chamber of the engine 10 during the intake stroke.

Air capacitors incorporated into the intake manifold will enable single-cylinder IC engines to be turbocharged. Three critical metrics determine the feasibility of the concept: the volume required to maintain adequate manifold pressure during the intake stroke; the time required to pressurize the capacitor and its contribution to turbo lag; and the density increase of the intake air due to pressurization from the turbocharger.

Figure 2:
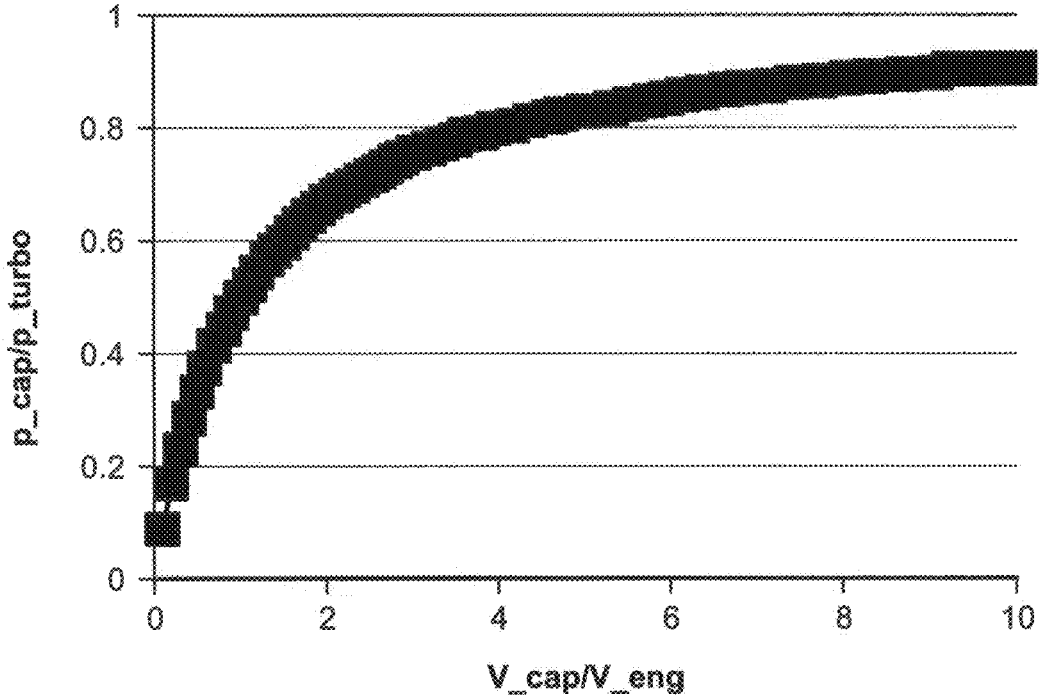
FIG. 2 is a graph showing the pressure in an air capacitor at the end of an intake stroke, non-dimensionalized by the turbocharger pressure, versus the volume of the capacitor non-dimensionalized by the engine capacity. This graph corresponds to steady state operating conditions.

The volume of the capacitor must be large enough to prevent the intake pressure from falling far below the turbocharger pressure during the intake stroke. We have established a target of maintaining at least 80% of the turbocharger pressure in the capacitor during intake. As a first-order estimate, the pressure in the capacitor can be considered to be equal to the turbocharger pressure at the start of the intake stroke, and all the air supplied to the engine during intake comes from the capacitor (with no additional air supplied by the turbocharger). FIG. 2 shows the pressure drop in the capacitor that will occur during intake as a function of its volume compared to the engine capacity. This analysis indicates that the capacitor should be 2 to 5 times the volume of the engine to maintain the desired pressure. A range of 4 to 5 is particularly preferred. Although this may sound like a large volume, it would equate to half the size of a soccer ball for a 625 cc engine.

Figure 3:
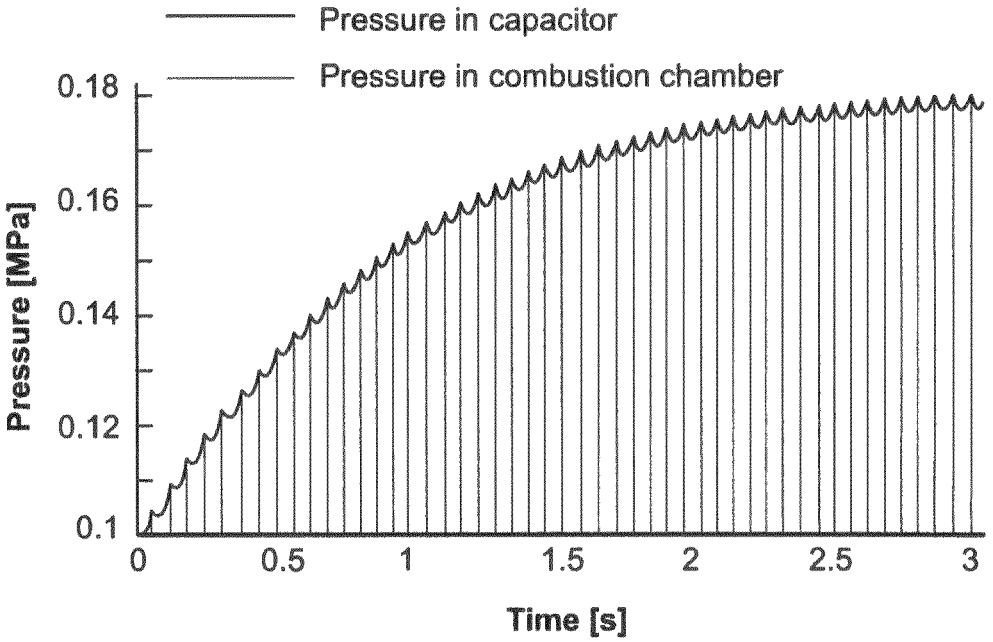
FIG. 3 is a graph of pressure versus time showing an air capacitor pressurization profile under transient conditions. Operating conditions are: 4 L capacitor, 2 atm turbo pressure, 2000 RPM engine speed, 0.8 L engine, and a compression ratio of 12:1.

To predict the time needed to pressurize the capacitor, the inventors treated the turbocharger as an intermittent pressure source that turns on only during the exhaust stroke of the engine (this approximation assumes the turbocharger spindle has zero rotational inertia). Air flow between the turbocharger and the capacitor was modeled using pipe flow with minor losses, and the resulting pressure rise in the capacitor was determined assuming isoentropic compression. Under these conditions and starting at atmospheric pressure, the capacitor can reach operating pressure in approximately two seconds at moderate engine speeds (FIG. 3).

Figure 4:
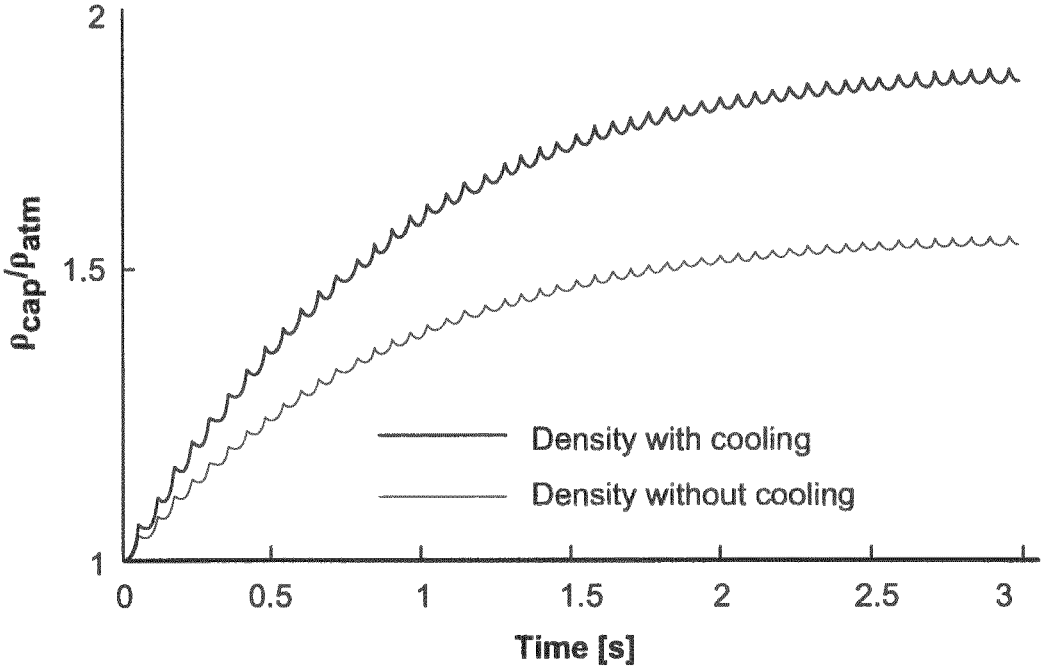
FIG. 4 is a graph showing density gain of intake air relative to atmospheric density with and without cooling. The engine model used for this analysis is the same as that in FIG. 3.

The density increase of intake air from atmospheric conditions represents, to first order, the power gain that could be achieved by a turbocharged engine compared to a naturally aspirated engine of the same capacity. As the air is pressurized by the turbocharger it heats up, which decreases the ideal density gain that would occur under isothermal compression. Intercoolers are often used with turbochargers to cool the compressed air and increase its density. FIG. 4 shows how the air capacitor would affect intake air density with and without heat transfer during the spool-up process shown in FIG. 3. With no cooling the density increase would be 50%; with ideal cooling (returning the temperature to atmospheric conditions) the increase would be 75%.

Figure 6:
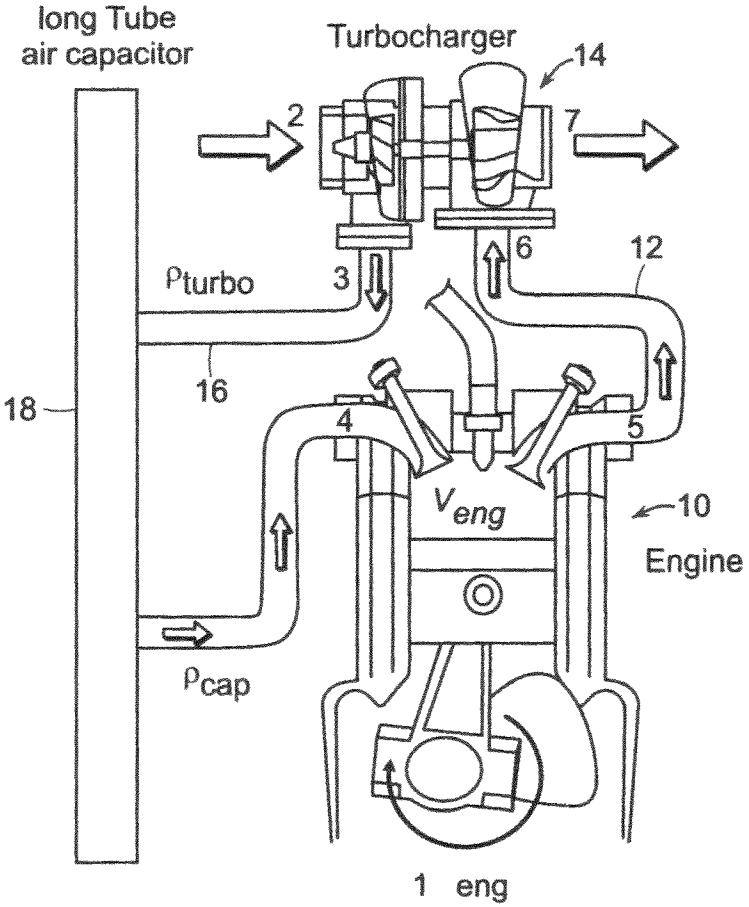
FIG. 6 is a schematic illustration of the engine system disclosed herein including a long tube air capacitor.
Figure 5:
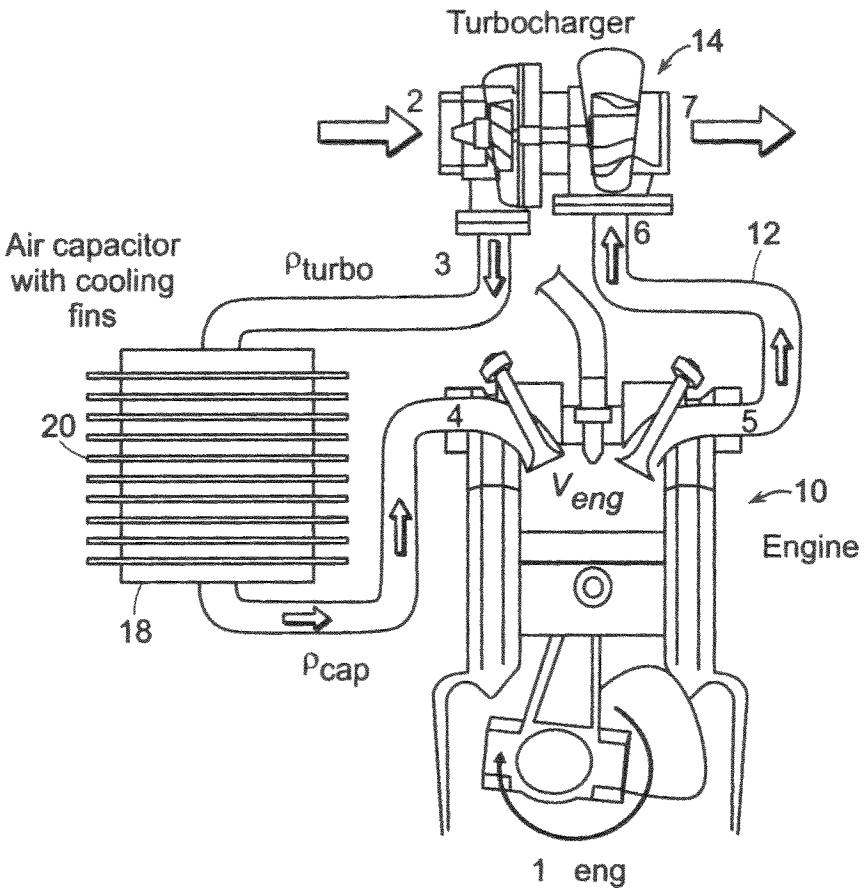
FIG. 5 is a schematic illustration of an embodiment of the engine system disclosed herein including cooling fins on the air capacitor.

FIGS. 5 and 6 show two embodiments of the invention in which intercooling is used to lower the temperature of the pressurized air introduced into the engine. As shown in FIG. 5, cooling fins 20 are disposed on the surface of the air capacitor 18 to cool the pressurized air therein. As shown in FIG. 6, the air capacitor 18 has the form of a long tube. The tube 18 might be part of the frame of a vehicle or other machine powered by the engine 10. Intercooling is achieved when the long tube air capacitor is disposed within an airflow.

Additional information about flow through the intake manifold into the engine and heat transfer out of the air capacitor may be found in "Method for Turbocharging Single Cylinder Four Stroke Engines", proceedings of the ASME 2014 International Design Engineering Technical Conferences, IDETC 2014. The contents of this paper are incorporated herein by reference.

What is claimed is:

1. Internal combustion engine system comprising:

a single cylinder engine having an engine volume, the single cylinder engine having an intake manifold for introducing air into the engine and an exhaust manifold for discharge of exhaust gases;

a turbocharger communicating with the exhaust manifold to receive the exhaust gases to power the turbocharger, the turbocharger including a compressor section communicating with the intake manifold to pressurize ambient air; and an air accumulator having an accumulator volume arranged to receive the pressurized ambient air from the turbocharger and to deliver the pressurized air to the engine, wherein the accumulator volume is selected so that at least about 80% of output pressure of the turbocharger is delivered to the cylinder throughout an intake stroke.

2. The engine system of claim 1 wherein the accumulator volume is in the range of approximately 2 to 5 times the engine volume.

3. The engine system of claim 2 wherein the accumulator volume is approximately 4 to 5 times the engine volume.

4. The engine system of claim 1 wherein the air accumulator includes structure to cool the air accumulator.

5. The engine system of claim 4 wherein the structure includes heat transfer features such as cooling fins disposed on a surface of the air accumulator.

6. The engine system of claim 4 wherein the single cylinder engine powers a device that includes frame tubing, wherein at least part of the frame tubing constitutes the air accumulator.

* * * * *